US005898023A

United States Patent [19]

Francisco et al.

[11] Patent Number: 5,898,023

[45] Date of Patent: Apr. 27, 1999

[54] LUBRICANT ADDITIVE COMPOSITION FOR INHIBITING VISCOSITY INCREASE AND DISPERSENCY DECREASE

[75] Inventors: Manuel A. Francisco, Washington, N.J.; Jason Z. Gao; Kim E. Fyfe, both of Sarnia, Canada

[73] Assignee: Exxon Research and Engineering Co., Florham Park, N.J.

[21] Appl. No.: 09/047,055

[22] Filed: Mar. 24, 1998

[51] Int. Cl.[6] ..... C10M 129/68

[52] U.S. Cl. ..... 508/236; 508/239; 508/455; 508/501

[58] Field of Search ..... 508/236, 239, 508/501, 503, 452, 455, 485

[56] References Cited

U.S. PATENT DOCUMENTS 5,200,101 4/1993 Hsu et al. .

OTHER PUBLICATIONS

Maleville, X, et al., Lubrication Science 9–1, Nov. 1996, (p. 3–60) "Oxidation of Mineral Base Oils of Petroleum Origin: The Relationship between Cehmical Composition, Thickening and Composition of Degradation Products".

Mirzoyeva, M. A., et al., S–Substituted Mercaptacetic Esters as Anticorrosion Additives to Lubricating Oils, (1988) (p. 245–252).

*Primary Examiner*—Jacqueline V. Howard
*Assistant Examiner*—Cephia D. Toomer

[57] ABSTRACT

A lube oil composition that inhibits lubricant viscosity increase and dispersancy decrease is described. The composition includes an oil of lubricating viscosity and a mixture of specified functionalized derivatives of pentaerythritol tetrakis 3-mercaptopropionate and amine antioxidants.

6 Claims, 2 Drawing Sheets

LUBRICANT ADDITIVE COMPOSITION FOR INHIBITING VISCOSITY INCREASE AND DISPERSENCY DECREASE

FIELD OF THE INVENTION

This invention relates to mixtures of certain pentaerythritol mercapto derivatives and amine antioxidants as lubricant additives.

BACKGROUND OF THE INVENTION

Antioxidants are added to lube oils to neutralize or minimize oil degradation chemistry. For example, U.S. Pat. No. 5,200,101 discloses certain amine/hindered phenol, acid anhydride and thiol ester-derived products are multifunctional antioxidant, antiwear and rust inhibiting lube additives.

The combination of a metallic dithiophosphate hydroperoxide decomposer and aminic antioxidant is reported to have a synergistic effect on lubricant antioxidant performance. See Maleville et al, Lubrication Science, V9, No. 1, pg. 3–60 (1996). Sulfur-substituted derivatives of mercapto carboxylic esters also are reported to posses antioxidant properties. See M. A. Mirozopeva et al., Naftekhimiya, V28, No. 6, pg. 831–837 (1988). There remains a need, nonetheless, for improved lubricant additives and lubricant compositions containing them.

SUMMARY OF THE INVENTION

It has been found that a mixture of certain functionalized derivatives of pentaerythritol tetrakis 3-mercaptopropionate and amine antioxidants provide a synergistic effect on inhibiting lubricant viscosity increase and dispersancy decrease which would otherwise occur when the lubricants are used in an oxidative environment. Thus, in one embodiment there is provided a lubricant composition comprising a major portion of an oil of lubricating viscosity and a minor portion of an additive comprising a mixture of a (i) a derivative of pentaerythritol tetrakis 3-mercaptopropionate prepared by reacting pentaerythritol tetrakis 3-mercaptopropionate (PEMP) with maleic anhydride and an alcohol and (ii) an amine antioxidant.

This and other embodiments of the invention will be described in detail hereafter.

DETAILED DESCRIPTION OF THE INVENTION

Figure 1:
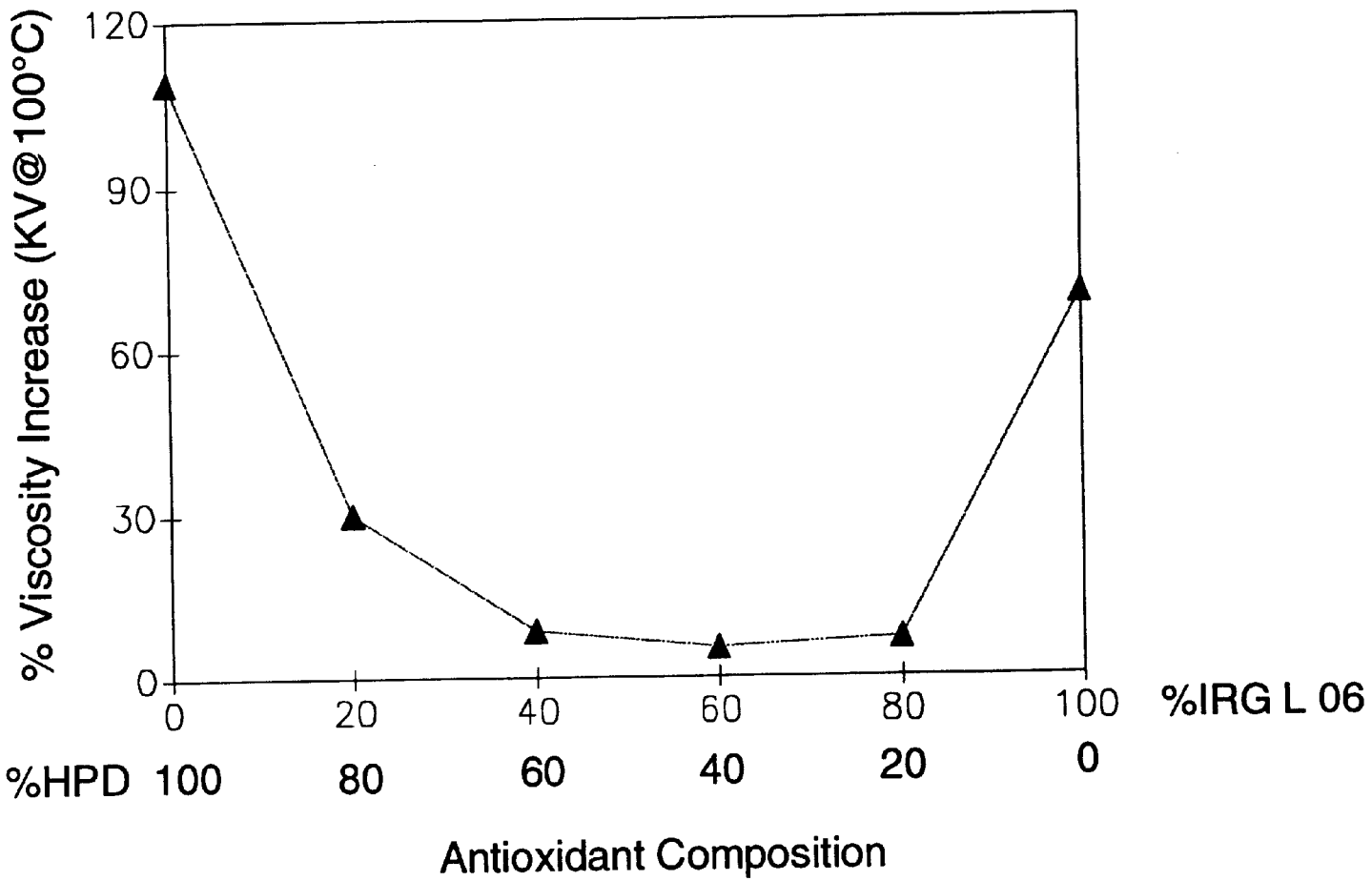
FIG. 1 shows the synergistic effect of the additive mixture of the invention in inhibiting viscosity increase in a lubricant.

In accordance with the invention, to inhibit lubricant viscosity increase and dispersancy decrease when a lubricant is used under oxidative conditions an effective amount of a mixture of certain functionalized derivatives of pentaerythritol tetrakis 3-mercaptopropionate (F-PEMP) and amine antioxidants are added to the lubricant. Specifically the F-PEMP derivatives are those prepared by reacting PEMP with maleic anhydride (MA) and an alcohol (ROH). The mole ratio of PEMP to MA typically will be in the range of 1:1 to 1:4 with a mole ratio of 1:2 preferred. The mole ratio of MA to ROH typically will be in the range of 1:1 to 1:2 and preferably 1:1. The alcohols used in preparing the derivatives are selected from linear or branched aliphatic primary, secondary or tertiary aliphatic alcohols or mixtures thereof having from about 8 to about 28 carbon atoms.

The reaction is carried out by contacting the PEMP, MA and ROH, in a non-reactive solvent such as tetrahydrofuran and preferably in an inert atmosphere, at a temperature and for a time sufficient for a F-PEMP to form. Typical temperatures are in the range of about 20° C. to about 110° C. Times range between about 1 to 24 hours. The F-PEMP is readily recovered by vacuum distillation to remove solvent.

The additive mixture of the present invention also includes an amine antioxidant, such as diphenylamines, naphthylphenylamines and alkyl substituted derivatives thereof having from about 4 to 24 carbon atoms in the alkyl substituent. Particularly preferred is an alkyl phenyl-alpha-naphthylamine having from 4 to 12 carbon atoms in the alkyl group.

In the practice the present invention the functionalized derivative (F-PEMP) and the amine antioxidant (AO) are used in a ratio sufficient to inhibit lubricant viscosity increase and dispersancy decrease. Typically F-PEMP to AO ratios will be in the range of 20:80 to 80:20 and preferably, 30:70 to 50:50 and more preferably 40:60.

The additive mixtures described herein are utilized in lubricating compositions in an amount which will inhibit lubricant viscosity increase and dispersancy decrease under conditions of use. Concentrations ranging from about 0.1 to 10 wt % based on the total weight of the lubricant composition can be used. Preferably the concentration is from 0.5 to 2 wt %.

In general the lubricant used in the compositions of the present invention may be any natural or synthetic oil of lubricating viscosity, as for example, from about 3 to 20 cSt at 100° C.

Other additives typically added to lubricants also may be present in the composition of the present invention. Such conventional additive types include viscosity modifiers, extreme pressure agents, corrosion-inhibitors, pour point depressants, detergents, dispersants, color stabilizing agents, and other additive materials generally known to those skilled in the art.

The present invention is exemplified by reference to the following examples.

EXAMPLE 1

This example illustrate the preparation of an F-PEMP.

Two solutions were prepared, using minimum volumes of tetrahydrofuran; one containing PEMP, the other containing maleic anhydride (MA). A sufficient amount of each solution was combined at room temperature to provide a reaction mixture containing PEMP and MA mole ratio of 1:4. To this reaction solution was added 0.02 mol % triethyl amine. The result mixture was heated at 60° C. for one hour with stirring and then allowed to cool to room temperature. Then n-octanol was added in a mole amount equal to the number of moles of MA. Next solvent was removed in vacuum at 70° C. to yield the F-PEMP, $C_{65}H_{108}O_{24}S_4$.

EXAMPLE 2

A series of compositions were prepared from a 600N base oil containing 5 wt % of polyisobutenylsuccinimide and to which was added 1 wt % of the F-PEMP of Example 1, an alkyl phenyl-alpha-naphthylamine sold under the trade name Irganox L06 by Ciba-Geigy, Basel, Switzerland, or a mixture of the two in the weight ratios shown in FIG. 1 in which HDP is the F-PEMP and IRG 106 is the Irganox L06. Each sample was evaluated in a 32 hour bench oxidation test which was conducted at 165° C. under a mixed air/nitrogen flow, with 40 ppm iron from added ferric acetylacetonate as a catalyst. The flow rates of air and nitrogen were controlled at 500 ml/minute and 350 ml/minute, respectively. The samples then were analyzed in terms of viscosity changes. The results are given in FIG. 1.

EXAMPLE 3

Figure 2:
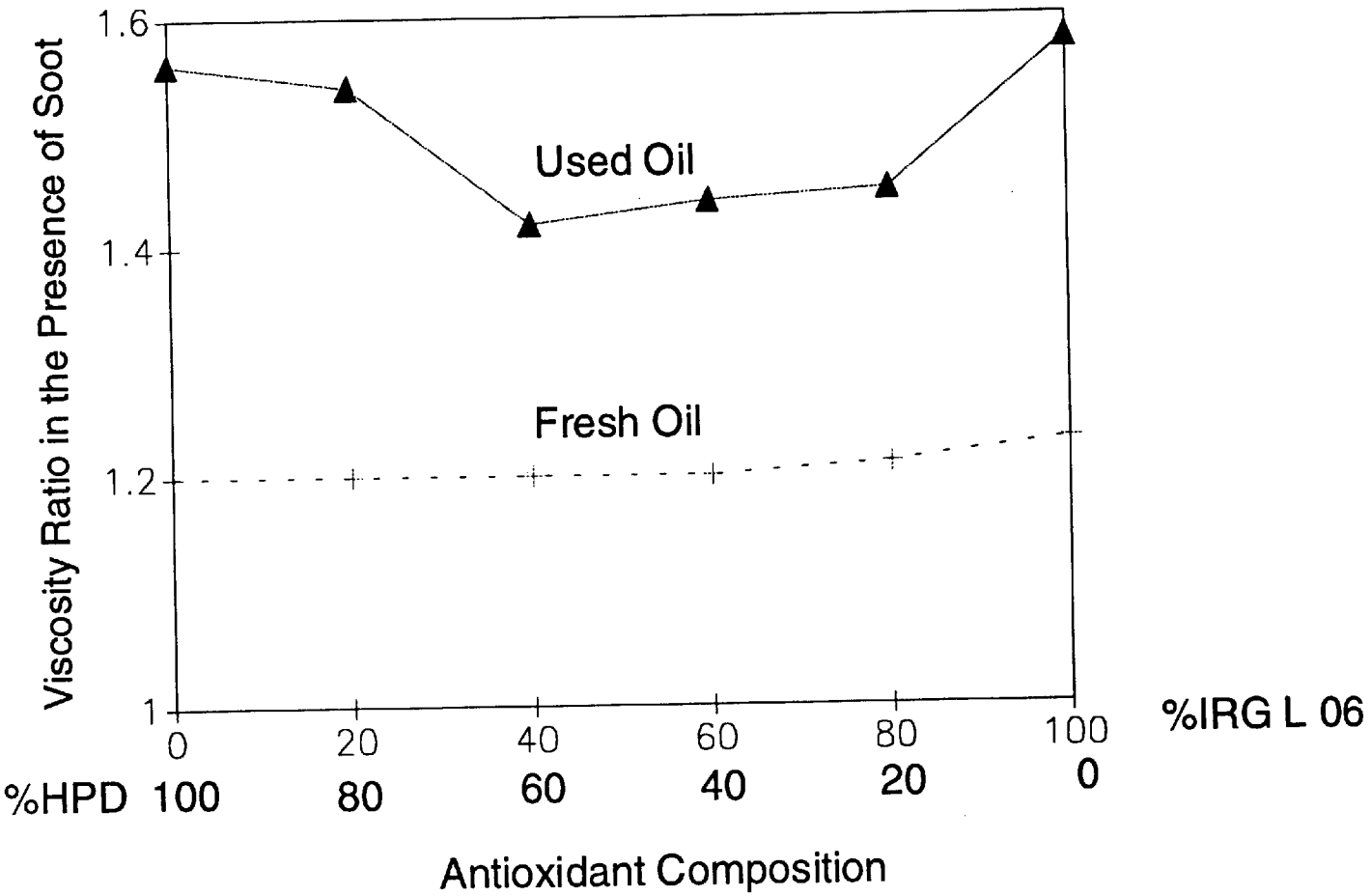
FIG. 2 shows the synergistic effect of the additive mixture of the invention in inhibiting dispersancy decrease in a lubricant.

The soot dispersancy of the oil after the oxidation test was determined by the viscosity ratio of the diluted test oil in the presence and absence of soot; the lower the ratio, the better the dispersancy. The test oil was mixed with the soot-laden base oil (3.6 wt % soot) from the GM 6.2 L engine at the ratio of 25:75 and the kinematic viscosity at 100° C. was measured. At the same time, the kinematic viscosity at 100° C. of the test oil—fresh base oil mixture at the same ratio (25:75) was also obtained. The results (ratio of these two viscosities) are given in FIG. 2. As in FIG. 1, HDP is the amount of F-PEMP of Example 1 and IRG L06, the amount of Irganox L06 described in Example 2.

What is claimed is:

1. A lubricant composition comprising:

a major portion of an oil of lubricating viscosity and a minor portion of an additive comprising a mixture of (i) a derivative of pentaerythritol tetrakis 3-mercaptoproprionate prepared by reacting pentaerythritol tetrakis 3-mercaptopropionate (PEMP) with maleic anhydride (MA) and an alcohol (ROH) and (ii) an amine antioxidant (AO) wherein the derivative and the AO are present in a weight ratio of from 20:80 to 80:20, and wherein the mole ratio of PEMP to MA is in the range of 1:1 to 1:4 and the mole ratio of MA to ROH is in the range of 1:1 to 1:2.

2. The composition of claim 1 wherein ROH is selected from the group consisting of linear or branched, primary, secondary, tertiary alcohols, and mixtures thereof having from about 8 to about 28 carbon atoms.

3. The composition of claim 2 wherein AO is selected from the group consisting of diphenylamines, naphthyl phenylamines, alkyl substituted diphenyl and naphthyl phenyl amines and mixtures thereof wherein the alkyl groups has from about 4 to about 24 carbon atoms.

4. A lubricant composition comprising:

a major portion of an oil of a lubricating viscosity; and an additive comprising a mixture in a weight ratio in the range of 20:80 to 80:20 of (i) a derivative of pentaeytiitol tetrakis 3-mercaptopropionate prepared by reacting pentaerythritol tetrakis 3-mercapto propionate (PEMP) with maleic anhydride (MA) and an alcohol (ROH) and (ii) an amine antioxidant (AO);

wherein the mole ratio of PEMP to MA is in the range of 1:1 to 1:4 and wherein ROH is a linear alcohol having 8 to 28 carbon atoms, and wherein AO is an alkyl phenyl naphylamine having from 4 to 24 carbon atoms in the alkyl group.

5. The composition of claim 4 wherein the weight ratio of the derivative to AO is about 40:60 to 60:40.

6. A method for inhibiting lubricant viscosity increase under conditions of use comprising adding to the lubricant an effective amount of an additive comprising a mixture of (i) a derivative of pentaerythritol tetrakis 3-mercaptopropionate prepared by reacting pentaerythritol tetrakis 3-mercapto propionate (PEMP) with maleic anhydride (MA) and an alcohol (ROH) and (ii) an amine antioxidant (AO);

wherein the mole ratio of PEMP to MA is in the range of 1:1 to 1:4 and wherein ROH is a linear alcohol having 8 to 28 carbon atoms, and wherein AO is an alkyl phenyl naphthylamine having from 4 to 24 carbon atoms in the alkyl group.

* * * * *